US011007630B2

(12) United States Patent
Wang

(10) Patent No.: US 11,007,630 B2
(45) Date of Patent: May 18, 2021

(54) STAPLER

(71) Applicant: APEX MFG. CO., LTD., Taichung (TW)

(72) Inventor: Rong-Yu Wang, Taichung (TW)

(73) Assignee: Apex Mfg. Co., Ltd., Taichung (TW)

( * ) Notice: Subject to any disclaimer, the term of this patent is extended or adjusted under 35 U.S.C. 154(b) by 171 days.

(21) Appl. No.: 16/237,955

(22) Filed: Jan. 2, 2019

(65) Prior Publication Data

US 2019/0134798 A1 May 9, 2019

Related U.S. Application Data

(63) Continuation-in-part of application No. 15/016,706, filed on Feb. 5, 2016, now abandoned.

(51) Int. Cl.
*B25C 5/16* (2006.01)
*B25C 5/02* (2006.01)

(52) U.S. Cl.
CPC ..... *B25C 5/1665* (2013.01); *B25C 5/0292* (2013.01); *B25C 5/1617* (2013.01); *B25C 5/1668* (2013.01)

(58) Field of Classification Search
CPC ... B25C 5/1665; B25C 5/0292; B25C 5/1617; B25C 5/1668; F16B 15/0015
USPC ..... 227/109
See application file for complete search history.

(56) References Cited

U.S. PATENT DOCUMENTS 2,117,741 A * 5/1938 Polzer ..... B25C 5/1603 227/109
2,150,127 A * 3/1939 Passek ..... B25C 5/0257 227/83
3,873,016 A * 3/1975 Fishbein ..... B25C 5/11 227/83
4,225,075 A * 9/1980 Chi ..... B25C 5/16 227/119
4,556,161 A * 12/1985 Oide ..... B25C 5/025 227/109
4,598,852 A * 7/1986 Olesen ..... B25C 5/0257 227/119
4,747,531 A * 5/1988 Brinkerhoff ..... A61B 17/0684 227/19
5,816,470 A * 10/1998 Plato ..... B25C 5/11 227/132
6,076,720 A * 6/2000 Deng ..... B25C 5/025 227/109
6,089,435 A * 7/2000 Malek ..... B25C 11/02 227/156

(Continued)

*Primary Examiner* — Dariush Seif
(74) *Attorney, Agent, or Firm* — Muncy, Geissler, Olds & Lowe, P.C.

(57) ABSTRACT

A stapler includes a main body, a magazine, a striker, and a driving portion. The main body encloses a receiving space and has an opening at the bottom of the front end thereof. The opening communicates with the receiving space. The magazine is arranged in the main body for receiving staples. The striker is arranged at the front end of the main body and is linearly slidable above the opening vertically. The driving portion is disposed on the main body and is connected to the striker to drive it to move downward to strike the staple out. The striker has a bottom face oriented frontward and downward so that an angle ranged from 3-15 degrees is defined between the bottom face and the horizontal plane.

4 Claims, 5 Drawing Sheets

(56) References Cited

U.S. PATENT DOCUMENTS

| | | | | |
|---|---|---|---|---|
| 6,698,642 | B2 * | 3/2004 | Chen | B25C 5/06 227/120 |
| 7,121,444 | B2 * | 10/2006 | Joyce | B25C 5/0242 227/132 |
| 7,438,206 | B2 * | 10/2008 | Kumayama | B25C 5/0242 227/120 |
| 7,617,883 | B1 * | 11/2009 | Mangone, Jr. | F16B 15/08 173/1 |
| 8,939,340 | B2 * | 1/2015 | Gardner | F16B 15/0015 227/110 |
| 2004/0232192 | A1 * | 11/2004 | Marks | B25C 5/0242 227/120 |
| 2005/0127129 | A1 * | 6/2005 | Marks | B25C 5/1637 227/134 |
| 2006/0016846 | A1 * | 1/2006 | Joyce | B25C 5/0242 227/132 |
| 2006/0231583 | A1 * | 10/2006 | Kumayama | B25C 5/1603 227/134 |
| 2007/0108251 | A1 * | 5/2007 | Marks | B25C 1/008 227/120 |
| 2007/0257080 | A1 * | 11/2007 | Kamins | B25C 5/10 227/132 |
| 2007/0272721 | A1 * | 11/2007 | Marks | B25C 5/11 227/132 |
| 2009/0114696 | A1 * | 5/2009 | Chen | B25C 5/10 227/8 |
| 2010/0059569 | A1 * | 3/2010 | Maemori | B25C 5/0207 227/155 |
| 2012/0286018 | A1 * | 11/2012 | Wang | B25C 5/11 227/139 |
| 2017/0225311 | A1 * | 8/2017 | Wang | B25C 5/1668 |

* cited by examiner

STAPLER

The present invention is a CIP of application Ser. No. 15/016,706, filed Feb. 5, 2016, the entire contents of which are hereby incorporated by reference.

BACKGROUND OF THE INVENTION

Field of the Invention

Description of the Prior Art

A conventional stapler includes a main body, a magazine, a striker, and a driving portion, such as a pressing arm or a trigger. The magazine is received in the main body for receiving nails. The striker is located at a front end of the main body and is linearly movable along a vertical direction. The driving portion is engaged with the striker to drive the striker to move downward to strike nails out.

The conventional magazine has an elastic element to push the nails frontward, but the elasticity can not be too strong to result the failure of striking. However, it also results that the first nail lacks of enough elastic force so they the lower end of the nail tends to move backward when the nail is hit by the striker. Thus, the nail may be inclined so that it becomes difficult to strike the nail out successfully. Therefore, the efficiency of working is reduced, and the nails and the components of the stapler may be abraded.

U.S. Pat. No. 4,598,852 provides a stapler whose striker is oblique with respect to the magazine in order to obliquely apply a staple on a surface. However, the staple is extremely easy to jam when struck out because the staple is pivoted. In fact, the staple is almost unable to be turned to be oblique to be struck out.

SUMMARY OF THE INVENTION

The main object of the present invention is to provide a stapler which reduces failures of striking.

To achieve the above and other objects, the stapler of the present invention includes a main body, a magazine, a striker, and a driving portion.

The main body encloses a receiving space and has an opening at a lower part of a front end thereof. The receiving space communicates with the opening. The magazine is arranged in the receiving space of the main body and is adapted for receiving a plurality of staples. The magazine extends horizontally to push the staples out horizontally. The striker is disposed on the front end of the main body and is linearly slidable above the opening along a vertical direction. The driving portion is disposed in the main body and is connected to the striker for driving the striker to move downward to strike the staples out. The striker has a bottom face at a bottom end thereof. When observing from a lateral side of the main body, the bottom face is oriented toward the front end of the main body and downward so that an angle is defined between the bottom face and a horizontal plane. The angle is ranged from 3 degrees to 15 degrees.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
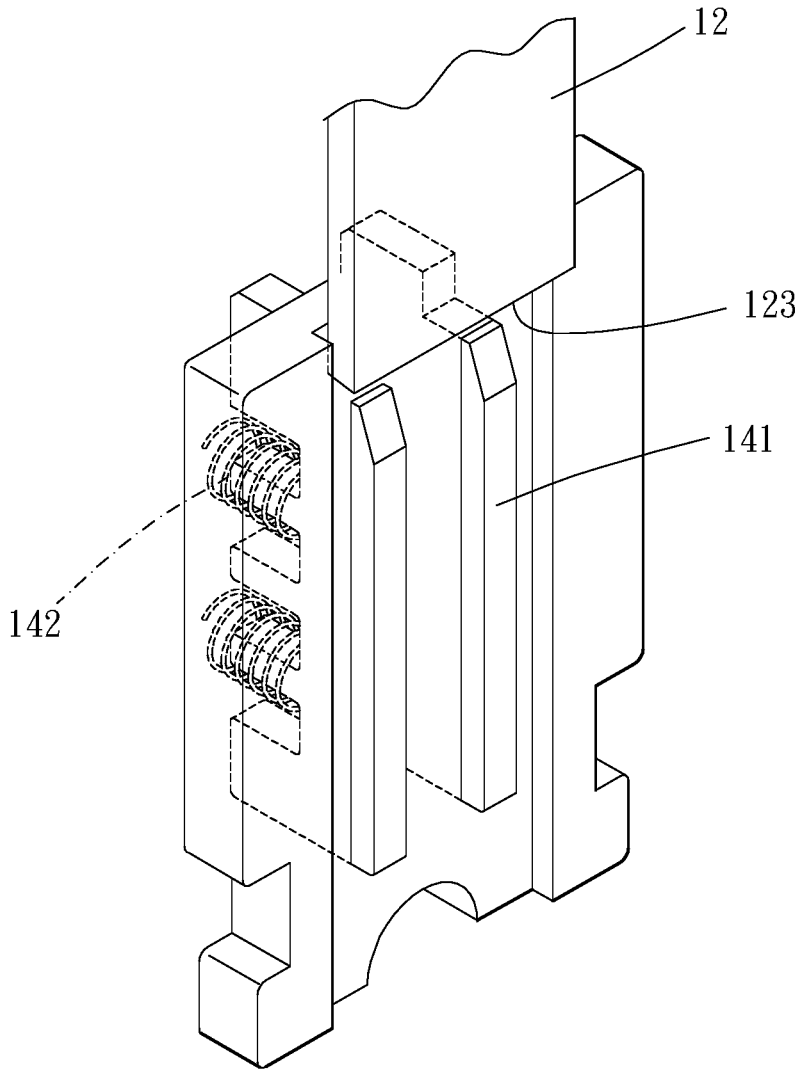
FIG. 1 is a partial stereogram of the present invention.
Figure 2:
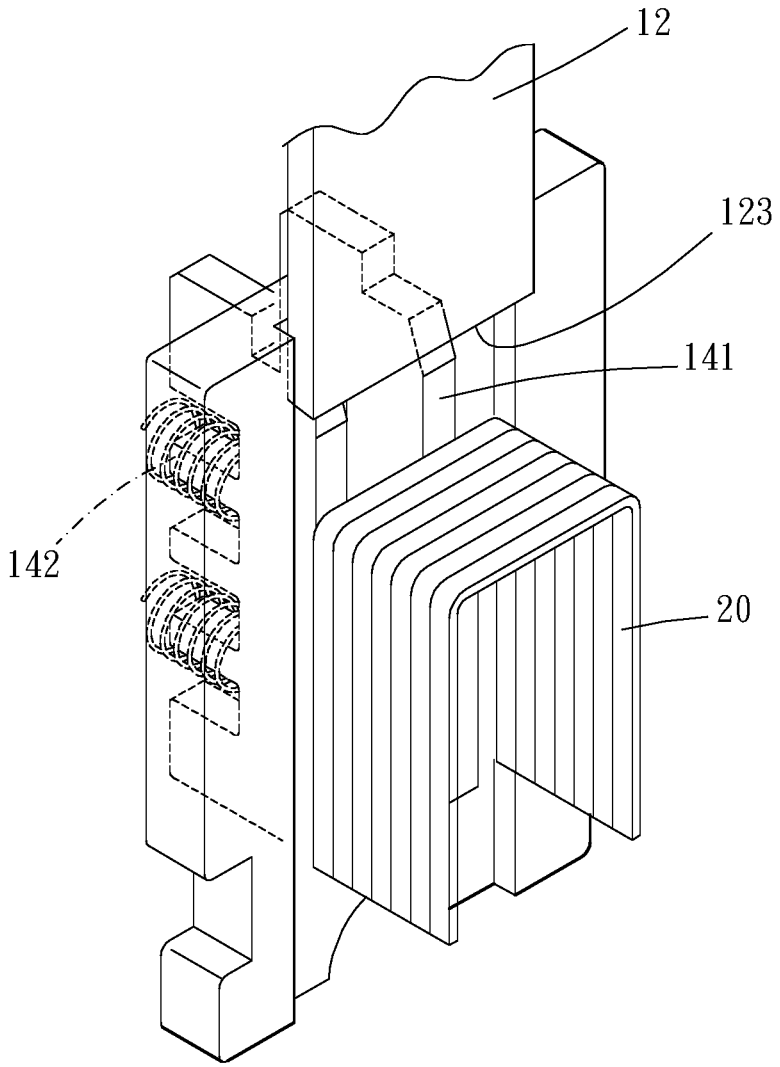
FIG. 2 is an illustration of the present invention.
Figure 3A:
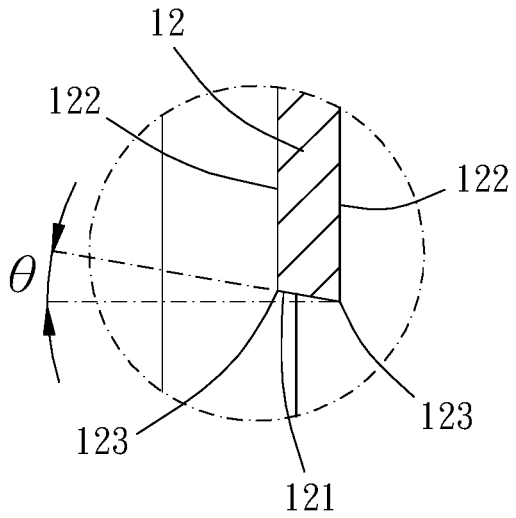
FIG. 3A is a partial enlargement of FIG. 3.
Figure 3:
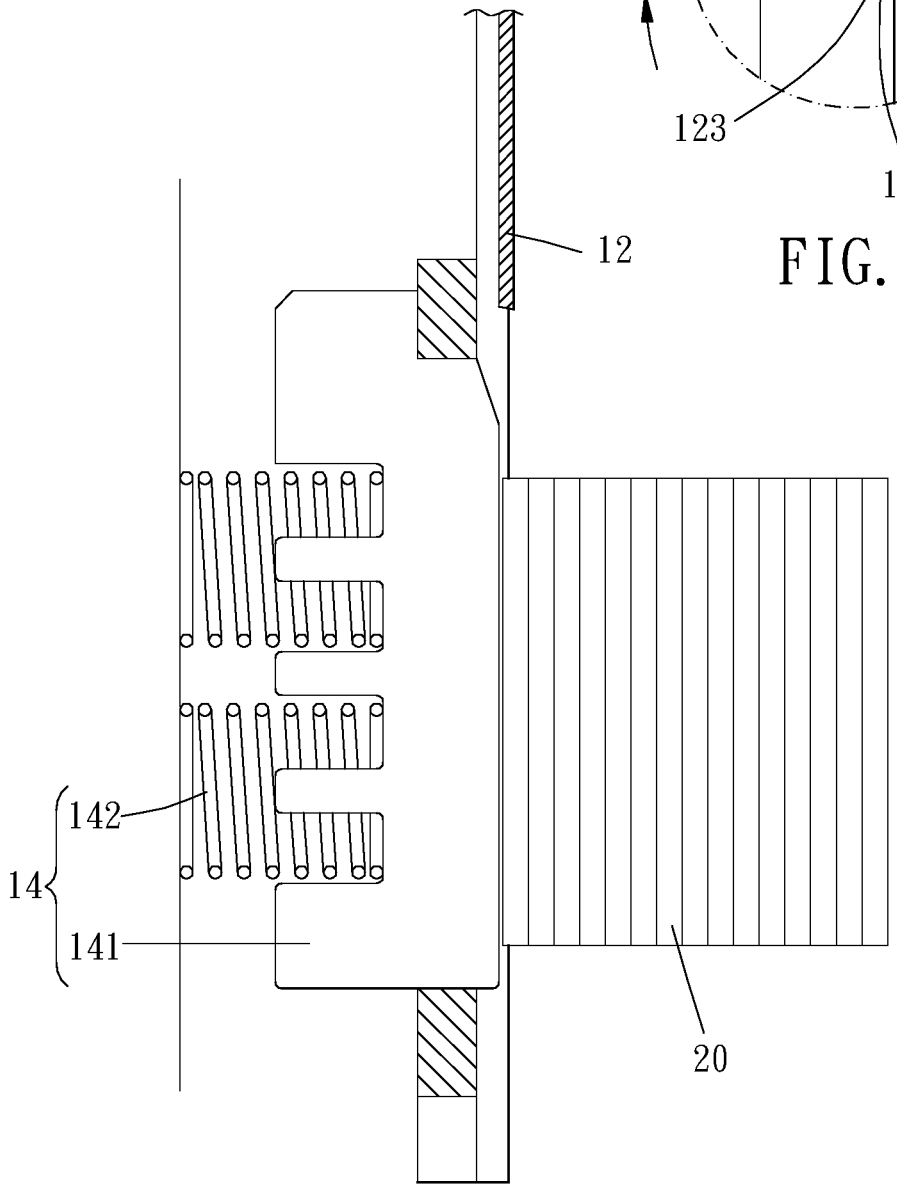
FIG. 3 is a profile of the present invention when a staple has not been stroke out.

Please refer to FIGS. 1 to 5, 3A, and 4A, the stapler of the present invention includes a main body 10, a magazine 11, a striker 12, and a driving portion 13.

The main body 10 encloses a receiving space and has an opening at a lower part of a front end thereof. The receiving space communicates with the opening. The magazine 11 is received in the main body 10 for receiving staples 20. The magazine 11 extends horizontally to push the staples 20 out horizontally. The striker 12 is arranged at the front end of the main body 10 and is linearly slidable above the opening along a vertical direction. That is, the direction that the striker 12 slides along is perpendicular to the direction that the staples 20 are pushed out along. The driving portion 13 is disposed on the main body 10 and is connected to the striker 12 to drive the striker 12 to move downward to strike the staples out. In the present embodiment, the driving portion 13 includes a pressing arm above the main body 10. Specifically, the striker 12 has a bottom face 121 at a bottom end thereof. When observing from a lateral side of the main body 10, the bottom face 121 is oriented toward the front end of the main body 10 and downward so that an angle is defined between the bottom face 121 and a horizontal plane. The angle is ranged from 3 degrees to 15 degrees. In addition, the lower portion of the bottom face 121 of the striker 12 corresponds to a rear portion of the staple 20 to be struck out. The striker 12 further has two lateral surfaces 122 which extend linearly and vertically downward, the two lateral surfaces 122 are located on two sides in a thicknesswise direction of the striker 12, the bottom face 121 is titled and non-perpendicular to the two lateral surfaces 122, each of the two lateral surfaces 122 has a bottom end edge 123 which extends linearly and horizontally, the bottom face 121 is a flat face and extends from the bottom end edge 123 of one of the two lateral surfaces 122 to the bottom end edge 123 of the other of the two lateral surfaces 122, and the striker 12 is configured to strike one of the staples 20 with only one bottom end edge 123.

In the present embodiment, a blocking structure 14 is also included. The blocking structure 14 includes an elastic element 142 and a blocking element 141. The blocking element 141 is located in front of the magazine 11 and the striker 12. The elastic element 142 is biased between the blocking element 141 and the front end of the main body 10 so that the blocking element 141 tends to move toward the magazine 11 to correspond to staples in different sizes and shapes.

Figure 4:
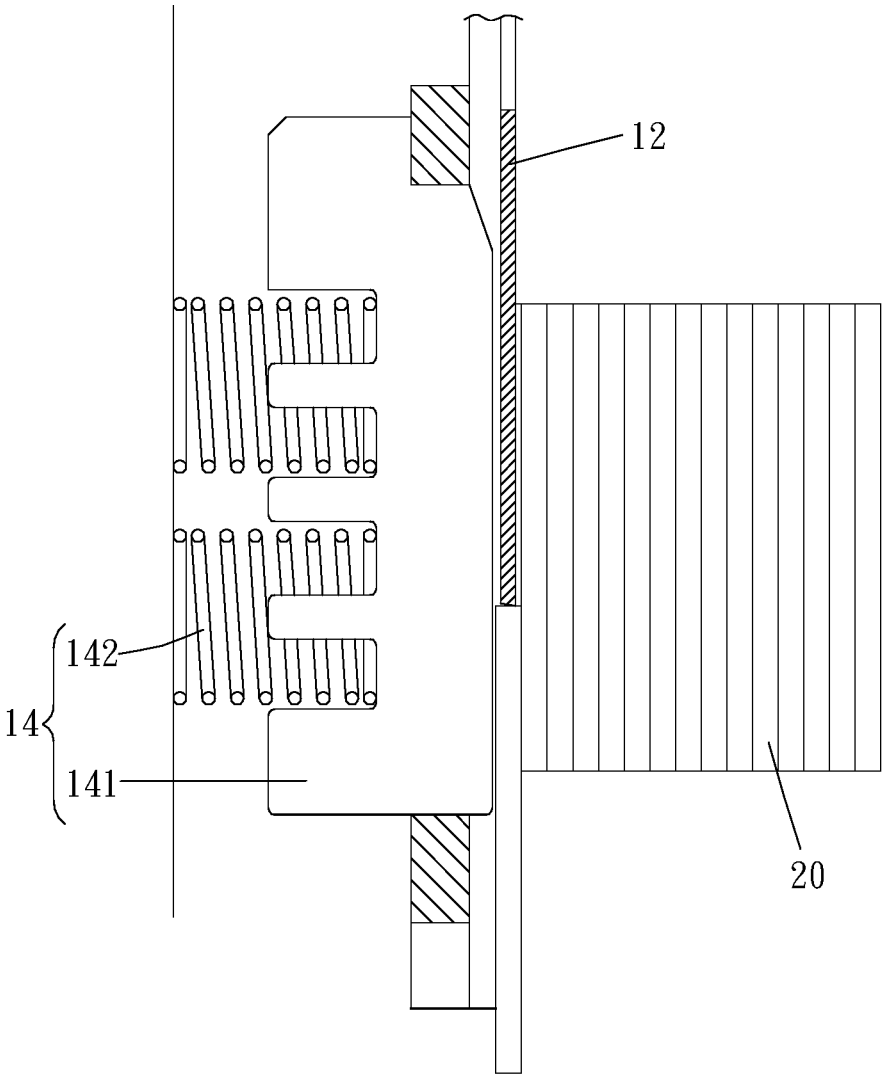
FIG. 4 is a profile of the present invention when a staple is stroke out.
Figure 4A:
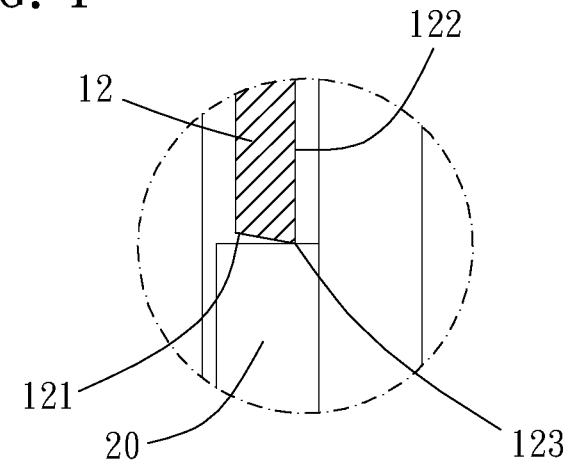
FIG. 4A is a partial enlargement of FIG. 4.
Figure 5:
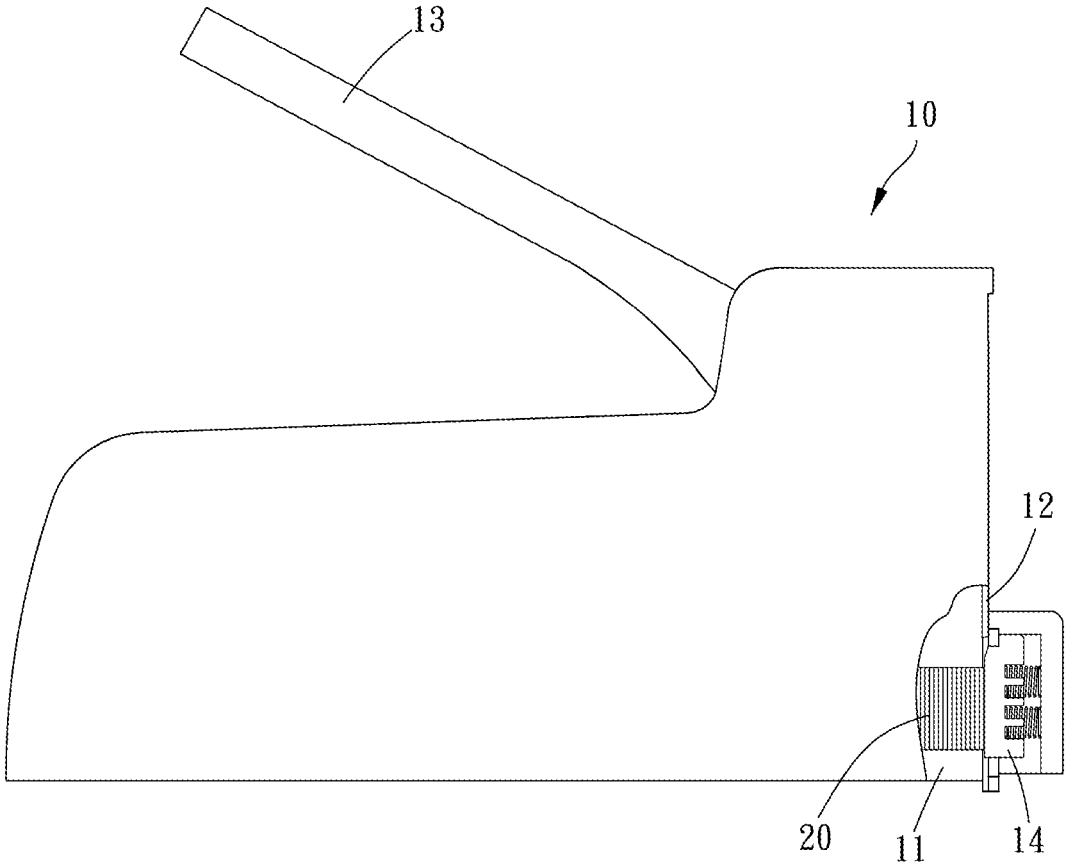
FIG. 5 is a partial profile of the present invention.

In conclusion, the striker 12 of the present invention has an inclined bottom face, so only the lower end of the striker 12 touches the rear portion of the staple 20 at the beginning so that the staple 20 receives a force clockwise (in FIGS. 4 and 4A). When the bottom face of the striker 12 further contacts the staple 20, the striker 12 continuously provides the force clockwise to the staple 20 to make the staple 20 move along the blocking element 141. Thus, the staple 20 can be stroke out along the blocking element 141 to prevent from failure of striking.

What is claimed is:

1. A stapler, including:

a main body, enclosing a receiving space, having an opening at a lower part of a front end thereof, the receiving space communicating with the opening;

a magazine, arranged in the receiving space of the main body, adapted for receiving a plurality of staples, the magazine extending along a horizontal direction to push the staples out horizontally;

a striker, disposed on the front end of the main body, being linearly slidable above the opening along a vertical direction;

driving portion, disposed in the main body and connected to the striker, adapted for driving the striker to move downward to strike the staples out;

wherein the striker has a bottom face at a bottom end thereof, the bottom face is a lowest face of the striker, when observing from a lateral side of the main body, the bottom face is oriented toward the front end of the main body and downward so that an angle is defined between the bottom face and a horizontal plane, the angle is ranged from 3 degrees to 15 degrees; and wherein the striker further has two lateral surfaces which extend linearly and vertically downward, the two lateral surfaces are located on two sides in a thicknesswise direction of the striker, the bottom face is tilted and non-perpendicular to the two lateral surfaces, each of the two lateral surfaces has a bottom end edge which extends linearly and horizontally, the bottom face is a flat face and extends from the bottom end edge of one of the two lateral surfaces to the bottom end edge of the other of the two lateral surfaces, and the striker is configured to strike one of the staples with only one bottom end edge.

2. The stapler of claim 1, wherein the driving portion includes a pressing arm located above the main body.

3. The stapler of claim 1, further including a blocking structure, the blocking structure including an elastic element and a blocking element, the bottom face facing the blocking element, the blocking element being disposed in front of the magazine and the striker, the elastic element being biased between the blocking element and the front end of main body so that the blocking element tends to move toward the magazine, the blocking structure being adapted for corresponding to staples in different sizes and shapes.

4. The stapler of claim 1, wherein a lowest portion of the bottom face of the striker corresponds to a rear portion of a staple to be stroke out.

* * * * *